US009736915B2

(12) United States Patent
Juslen

(10) Patent No.: US 9,736,915 B2
(45) Date of Patent: Aug. 15, 2017

(54) DRIVER FOR A LIGHT SOURCE

(71) Applicant: Helvar Oy Ab, Karkkila (FI)

(72) Inventor: Henri Juslen, Kerava (FI)

(73) Assignee: Helvar Oy AB, Karkkila (FI)

( * ) Notice: Subject to any disclaimer, the term of this patent is extended or adjusted under 35 U.S.C. 154(b) by 0 days.

(21) Appl. No.: 14/777,802

(22) PCT Filed: Mar. 18, 2014

(86) PCT No.: PCT/EP2014/055406

§ 371 (c)(1),
(2) Date: Sep. 17, 2015

(87) PCT Pub. No.: WO2014/147065

PCT Pub. Date: Sep. 25, 2014

(65) Prior Publication Data

US 2016/0286633 A1 Sep. 29, 2016

(30) Foreign Application Priority Data

Mar. 18, 2013 (EP) ..... 13159725

(51) Int. Cl.
*H05B 33/00* (2006.01)
*H05B 37/02* (2006.01)
(Continued)

(52) U.S. Cl.
CPC ..... *H05B 37/0281* (2013.01); *H05B 33/089* (2013.01); *H05B 33/0815* (2013.01); *H05B 37/0209* (2013.01); *H05B 41/38* (2013.01)

(58) Field of Classification Search
CPC ..... H05B 37/0218; H05B 33/0806; H05B 33/0818; H05B 33/0842; H05B 33/0863; H05B 37/02; H05B 37/0245; H05B 37/029; H05B 39/042; H05B 39/081; F21K 9/00; F21K 9/23
See application file for complete search history.

(56) References Cited

U.S. PATENT DOCUMENTS

2006/0002110 A1* 1/2006 Dowling ..... F21K 9/00 362/249.05
2006/0170376 A1 8/2006 Piepgras et al. ..... 315/295
(Continued)

FOREIGN PATENT DOCUMENTS

DE 199 12 185 A1 9/2000
WO WO 2010/085882 A1 8/2010

*Primary Examiner* — Monica C King
(74) *Attorney, Agent, or Firm* — Harrington & Smith

(57) ABSTRACT

An arrangement for driving one or more light sources is provided. According to an example embodiment, the arrangement includes observing durations of active periods, wherein an active period corresponds to a continuous period of operating power being supplied to a driver apparatus, selecting one of a plurality of lighting programs for the driver apparatus in accordance with the observed durations of one or more active periods, wherein a lighting program defines the desired characteristics of light provided by the one or more light sources as a function of time for a subsequent active period, and controlling, in response to an active period, provision of operating power from the driver apparatus to the one or more light sources in accordance with the most recently selected lighting program.

15 Claims, 8 Drawing Sheets

(51) Int. Cl.
*H05B 33/08* (2006.01)
*H05B 41/38* (2006.01)

(56) References Cited

U.S. PATENT DOCUMENTS

| | | | | |
|---|---|---|---|---|
| 2006/0278808 | A1 | 12/2006 | Hick et al. | 250/205 |
| 2012/0068601 | A1 | 3/2012 | Rohner et al. | 315/86 |
| 2012/0249017 | A1 | 10/2012 | Grady | 315/360 |

* cited by examiner

DRIVER FOR A LIGHT SOURCE

FIELD OF THE INVENTION

The invention relates to control of operation of one or more light sources. In particular, embodiments of the invention relate to a driver that is able to select a lighting program and to control operation of one or more light sources accordingly, as well as to a method and to a computer program for carrying out the selection and control.

BACKGROUND

Typically outdoor lighting provided for public places, such as for towns, cities or districts thereof are operated by light sensor based or clock/timer based control systems for switching the lights on or off. Such an arrangement may involve issuing control signals e.g. via dedicated control cables or by employing power-line communication (PLC) techniques to one or more relays in a lightning cabinet, which relays in turn pass the operating power to one or more lights sources accordingly. Such systems typically only allow switching the light sources on or off but do not provide e.g. dimming capabilities.

Recently, two types of systems that also allow dimming have been provided. Simple ones are capable of dimming down the light sources for a predetermined period(s) of time within a lighting period, which lighting period typically covers the night time. A shortcoming of such systems is that ballasts and/or driver apparatuses employed therein do not offer any flexibility or possibilities for adjusting the dimming characteristics. Consequently, the energy consumption of such a lighting system may be unnecessarily high and/or the provided lighting level cannot be tailored to meet the required characteristics.

More advanced systems may allow control of lighting by a PLC technique, via a wireless connection or by employing dedicated control cables. While such systems may provide rather versatile possibilities for controlling dimming (and other) behavior of lighting, on the other hand in many cases they provide a level of sophistication greatly exceeding that required for control of lighting of public places and hence incur unnecessarily high costs and possibly also reliability problems.

SUMMARY

Consequently, it is an object of the present invention to provide a technique that is suitable for controlling the lighting of public places and/or other outdoor facilities that provides some flexibility in controlling the intensity and/or other characteristics of the lighting but that is reliable and straightforward to implement without incurring significant changes to the existing infrastructure.

The objects of the invention are reached by an apparatus, by a method, by a computer program and by an arrangement as defined by the respective independent claims.

According to an example embodiment, an apparatus for driving one or more light sources is provided. The apparatus comprises a monitoring portion configured to observe durations of active periods, wherein an active period corresponds to a continuous period of operating power being supplied to the apparatus, a mode setting portion configured to select one of a plurality of lighting programs for the apparatus in accordance with the observed durations of one or more active periods, wherein a lighting program defines the desired characteristics of light provided by the one or more light sources as a function of time for a subsequent active period, and a control portion configured to, in response to an active period, control provision of operating power from the apparatus to the one or more light sources in accordance with the most recently selected lighting program.

According to another example embodiment, a method for driving one or more light sources is provided. The method comprises observing durations of active periods, wherein an active period corresponds to a continuous period of operating power being supplied to a driver apparatus, selecting one of a plurality of lighting programs for the driver apparatus in accordance with the observed durations of one or more active periods, wherein a lighting program defines the desired characteristics of light provided by the one or more light sources as a function of time for a subsequent active period, and controlling, in response to an active period, provision of operating power from the driver apparatus to the one or more light sources in accordance with the most recently selected lighting program.

According to another example embodiment, a computer program for driving a light source is provided. The computer program comprises one or more sequences of one or more instructions which, when executed by one or more processors, cause an apparatus at least to observe durations of active periods, wherein an active period corresponds to a continuous period of operating power being supplied to the driver apparatus, to select one of a plurality of lighting programs for the driver apparatus in accordance with the observed durations of one or more active periods, wherein a lighting program defines the desired characteristics of light provided by the one or more light sources as a function of time for a subsequent active period and to control, in response to an active period, provision of operating power from the driver apparatus to the one or more light sources in accordance with the most recently selected lighting program.

The computer program may be embodied on a volatile or a non-volatile computer-readable record medium, for example as a computer program product comprising at least one computer readable non-transitory medium having program code stored thereon, the program code, which when executed by an apparatus, causes the apparatus at least to perform the operations described hereinbefore for the computer program in accordance with an example embodiment.

The exemplifying embodiments of the invention presented in this patent application are not to be interpreted to pose limitations to the applicability of the appended claims. The verb "to comprise" and its derivatives are used in this patent application as an open limitation that does not exclude the existence of also unrecited features. The features described hereinafter are mutually freely combinable unless explicitly stated otherwise.

The novel features which are considered as characteristic of the invention are set forth in particular in the appended claims. The invention itself, however, both as to its construction and its method of operation, together with additional objects and advantages thereof, will be best understood from the following detailed description of specific embodiments when read in connection with the accompanying drawings.

DESCRIPTION OF SOME EMBODIMENTS

Figure 1:
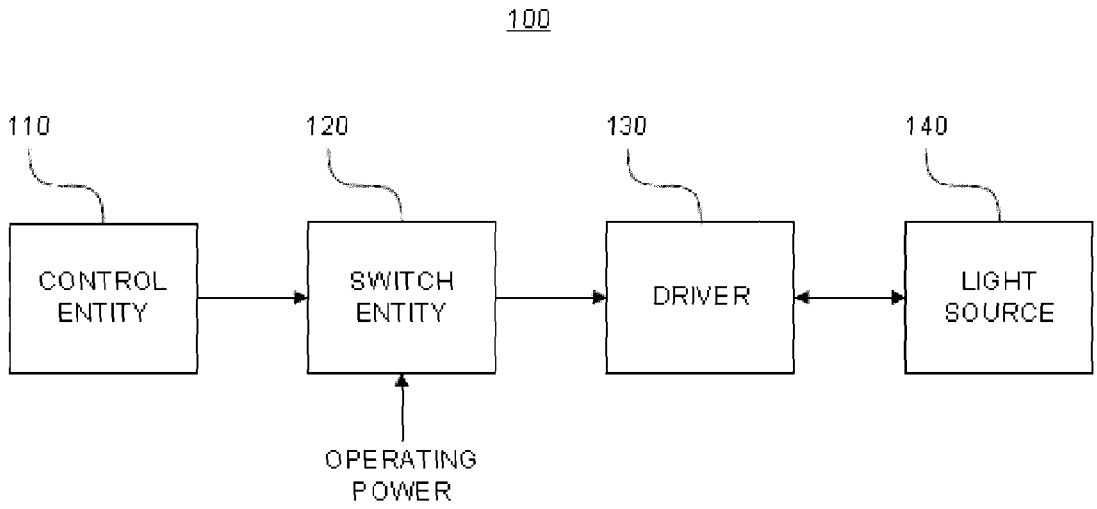
FIG. 1*a* schematically illustrates an exemplifying arrangement in accordance with an example embodiment.
FIG. 1*b* schematically illustrates an exemplifying arrangement in accordance with an example embodiment.

FIG. 1*a* schematically illustrates an exemplifying arrangement 100 suitable for example for providing and controlling outdoor lighting of public places, such as parks, streets, residential areas, districts of towns or cities or even towns or cities in their entirety. Equally well the arrangement 100 can be employed for providing and controlling outdoor lighting for private properties, such as shopping malls, office buildings, apartment buildings, private houses and their surroundings. The arrangement 100 comprises a control entity 110 for controlling the power supply to the light sources 140, a switching entity 120 for controlling the supply of operating power to the driver 130 in accordance with control signal(s) received from the control entity 110, a driver 130 for controlling operation of a light source 140 coupled thereto on basis of the operating power received via the switching entity 120.

Figure 1B:
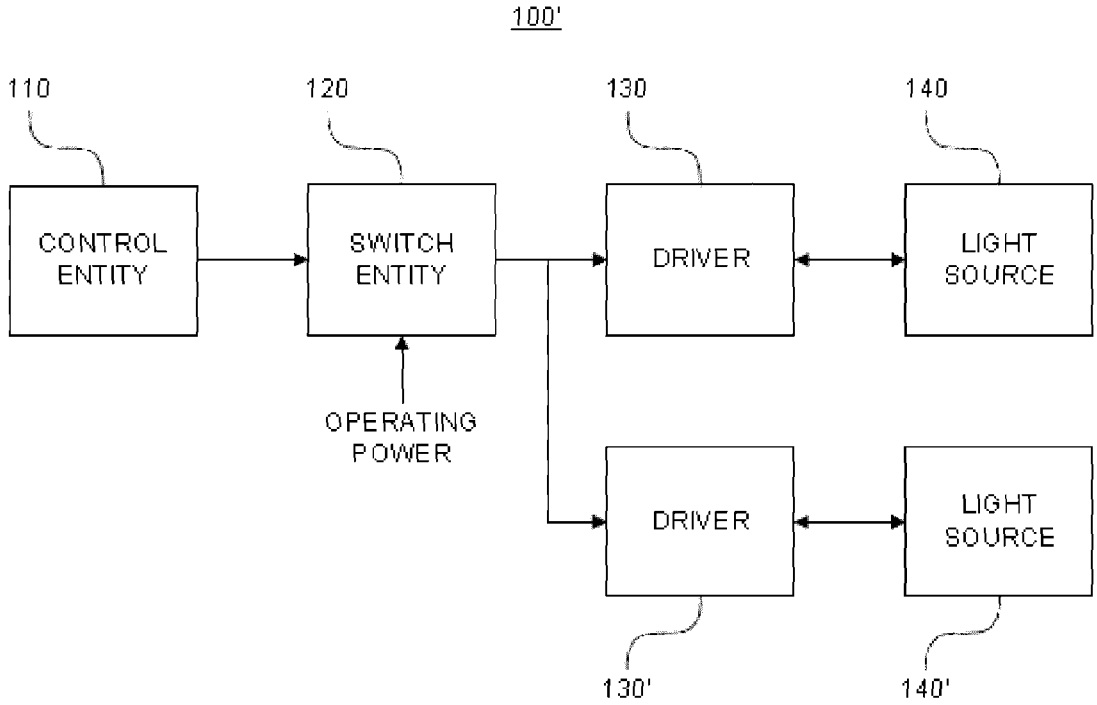

FIG. 1*b* schematically illustrates another exemplifying arrangement 100' as a variation of the arrangement 100, the arrangement 100' involving a second driver 130' for controlling operation of a light source 140' coupled thereto on basis of the operating power received via the switching entity 120. Separate drivers 130, 130', typically of different characteristics, may be useful e.g. to control operation of light sources 140, 140' of different types and/or to control operation of light sources 140, 140' of otherwise different characteristics or having different requirements with respect to operating power supplied thereto.

Although the arrangements 100, 100' are depicted with each driver 130, 130' controlling a single respective light source 140, 140', each of the drivers 130, 130' may be arranged to control one or more respective light sources 140, 140'. Along similar lines, instead of controlling power supply to one or two drivers 130, 130', the switching entity 120 generalizes into one arranged to control power supply to one or more drivers 130, 130', each arranged to control respective one or more light sources 140, 140'. Furthermore, the control entity 110 may be arranged to control the power supply to the light sources 140, 140' by controlling one or more switching entities 120, each switching entity arranged to control power supply to respective one or more drivers 130, 130' and each of the one or more drivers 130, 130' arranged to control respective one or more light sources 140, 140'.

The control entity 110 may comprise for example one or more user-operable switches that can be employed to manually control issuing one or more controls signals to the switching entity 120, consequently resulting in the switching entity 120 to supply operating power to the one or more drivers 130, 130' in order to the drivers 130, 130' to switch the operating power to the respective one or more light sources 140, 140', i.e. to turn the lights on or off. The one or more control signals may be provided to the switching entity 120 e.g. via dedicated control cables or by employing a PLC technique. As a further example, the one or more control signals may be provided to the switching entity over a wireless link, e.g. one based on a cellular communication technique such as GSM.

As another example, alternatively or additionally, the control entity 110 may comprise an automated control arrangement comprising one or more light sensors arranged to issue the one or more control signals that cause turning the lights on and/or off in accordance with the observed level of ambient light. As a further example, alternatively or additionally, such an automated control arrangement may comprise one or more timers that may be arranged to issue the one or more control signals that cause turning the lights on and/or off according to a predetermined rule, e.g. in order to provide lighting for a period of desired duration starting at a desired point of time. Typically, a sensor arrangement or a timer arrangement aims to automatically control the lights to be turned on for the time of the day when there is little or no daylight available. The control entity 110 may be arranged to employ a combination of control means, e.g. a combination of the user-operable switch, one or more light sensor and/or one or more timers, for example such that after manually controlling to switch the lights on, the lights will be turned off after a desired period of time and/or in response to observed level of ambient light exceeding a predetermined threshold level. As another example in this regard, the one or more control signals causing the lights to be switched on may be issued in response to observed level of ambient light falling below a predetermined threshold and subsequently one or more control signals causing the lights to be switched off are issued after a predetermined period of time.

As pointed out hereinbefore, the control entity 110 may be arranged to issue the one or more control signals to several switching entities 120. Such an arrangement may be useful e.g. in relative large scale lighting systems or arrangements covering a plurality of public places such as parks, streets, districts of towns/cities etc. In smaller scale lighting systems or arrangements, such as apartment buildings and private houses, the control entity 110 may be omitted an a user may directly operate the switching entity 120 e.g. via a user-operable switch or a corresponding arrangement provided in the switching entity 120.

The switching entity 120 may comprise for example one or more relays, each relay arranged to control supply of operating power to one or more drivers 130, 130' coupled thereto. The operating power is obtained from an external power supply or power source, typically from mains electricity.

The driver 130, 130' is preferably capable of adjusting the characteristics of light provided by the respective one or more light sources 140, 140' it is arranged control. The adjustment of characteristics may comprise, for example, adjustment of the light intensity, the adjustment of color of light and/or the adjustment of the color temperature of light provided by the respective one or more light sources 140, 140'. The adjustment may be provided e.g. on basis of one or more control signals received from the switching entity 120. The driver 130, 130' may be for example a light emitting diode (LED) driver and, consequently, the respective one or more light sources 140, 140' the driver 130, 130' is arranged to control comprise LED light sources. As another example, the driver 130, 130' may comprise a driver for a high-intensity discharge (HID) lamp, such as a sodium vapor lamp or a mercury vapor lamp and, consequently, the one respective one or more light sources 140, 140' are HID lamps of a corresponding type. Generally speaking, any light sources 140, 140' or any combination of light sources 140, 140' that enable adjustment of light characteristics thereof may be employed together with a driver 130, 130' of respective type.

In case the driver 130, 130' is arranged to control operation of respective two or more light sources 140, 140', the two or more light sources 140, 140' may be arranged into one or more luminaires. Consequently, the driver 130, 130' may be configured to control light sources of one or more luminaires.

Figure 2:
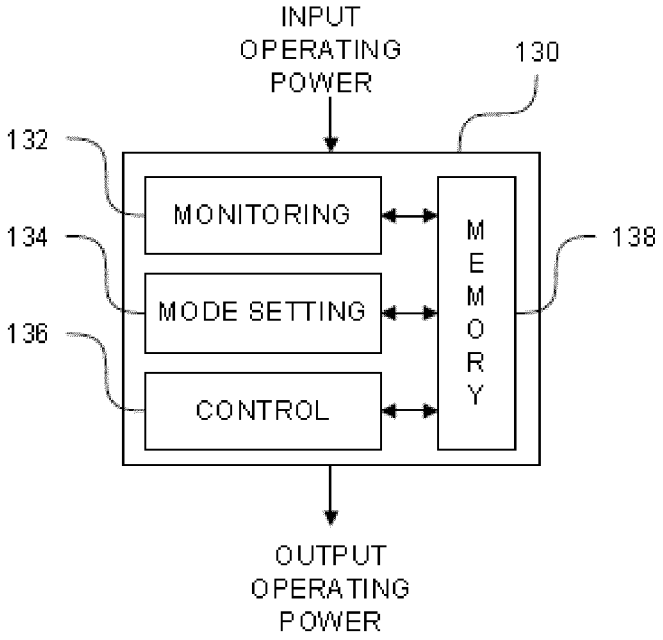
FIG. 2 schematically illustrates a driver in accordance with an example embodiment.

FIG. 2 schematically illustrates the driver 130, 130'. The driver 130, 130' comprises a monitoring portion 132 for observing durations of periods of operating power being supplied to the driver 130, 130', a mode setting portion 134 for adjusting the operation of the driver 130, 130' and a control portion 136 for controlling the operation of the one or more light sources 140. The driver 130, 130' may further comprise a memory 138 or the driver 130, 130' may otherwise have access to a memory, either in the driver apparatus or in another entity connected or coupled to the driver 130, 130'. One or more of the monitoring portion 132, the mode setting portion 134 and the control portion 136 may be configured to read from and/or to write to the memory 138 (or to/from a memory accessible by the driver 130 but provided outside the driver 130, 130').

The driver 130, 130' may be provided e.g. in a driver apparatus. The driver 130, 130' and/or the driver apparatus is provided with means for receiving the operating power and means for providing operating power to the one or more light sources 140, 140'. Consequently, the driver apparatus may be provided with an arrangement for connecting or coupling the one or more light sources 140, 140' to the driver 130, 130'. The driver 130, 130' or the driver apparatus typically comprises further portions, for example a power converter for converting an operating power supplied to the driver 130, 130' or to the driver apparatus to exhibit characteristics suitable for driving the operation of the one or more light sources 130, 130'. As another example, the driver 130, 130' may further comprise feedback circuitry arranged to monitor electric current supplied to the one or more light sources 140, 140' in order to facilitate driving the power converter in a desired manner. In context of the present invention such general driver functionality that is well known in the art may be conceptually provided e.g. in a driver portion of the driver 130, 130' or the driver apparatus.

The monitoring portion 132 may be configured to observe durations of continuous periods of operating power being supplied to the driver 130, 130' or to the driver apparatus. A single period of operating power being continuously supplied to the driver 130, 130' may be referred to as an active period. Hence, the monitoring portion may be configured to observe durations and/or timing of active periods and store information regarding the observations to a memory, e.g. the memory 138, for subsequent use by the mode setting portion 134. The information regarding a given observed active period may comprise, for example, one or more of the following: information indicating the duration of the given active period, information indicating starting time of the given active period, information indicating ending time of the given active period, information indicating the time between the beginning of the given active period and the end of the active period (immediately) preceding the given active period. The monitoring portion 132 may be configured to keep information regarding a predetermined number of most recent active periods. As another example, the monitoring portion 132 may be configured to keep information regarding active periods that have occurred within a predetermined period of time, e.g. within a predetermined period of time from the current time.

The monitoring portion 132 may be further configured to observe durations and/or timing of non-active periods, i.e. continuous periods of operating power not being supplied to the driver 130, 130' or to the driver apparatus, and store information regarding the observations to a memory, e.g. the memory 136, for subsequent use by the mode setting portion 134. Like in case of the active periods, the monitoring portion 132 may be configured to keep information regarding a predetermined number of most recent non-active periods or information regarding the non-active periods covering a predetermined time window. Instead of the monitoring portion 132 actively keeping track of the non-active periods, the information indicative of the durations and/or timing of non-active periods may be derivable from the information regarding the observed active periods.

As described hereinbefore, basically an active period is a continuous period of operating power being supplied to the driver 130, 130' or to the driver apparatus, typically via the switching element 120 in control of the control element 110. However, the monitoring portion 132 may be configured to ignore short interruptions in operating power supplied to the driver 130, 130' in order to avoid short-term disturbances and/or other unintentional short-term failures to provide operating power to disturb monitoring and evaluation of durations of active periods. As an example, the monitoring portion 132 may be configured to ignore interruptions in received operating power that are shorter than or equal to a threshold duration $Th_1$, where the value of the threshold duration $Th_1$ may be selected e.g. from the range from 1 to 5 seconds. In other words, the monitoring portion 132 may be configured to consider an active period to be completed only in response to a non-active period that is longer than the threshold duration $Th_1$.

Alternatively, the monitoring portion 132 may be configured to consider a non-active period that is shorter than the threshold $Th_1$ as an indication of an error condition in the system and, consequently, the mode setting portion 134 may be configured to resort to a default lighting program (as described hereinafter) in response to a non-active period having duration that does not exceed the threshold $Th_1$.

The mode setting portion 134 is configured to select one of a plurality of lighting programs for the driver 130 in accordance with the observed durations of one or more active periods. The lighting program is selected for one or more subsequent active periods. In other words, the observed durations of the active periods serve as control signal(s) arranged to control the manner of the driver 130, 130' adjusting the characteristics of light to be provided by the one or more light sources 140 during one or more subsequent active periods, thereby dispensing with the need to provide dedicated control cables or a wireless arrangement for providing the control signal(s) hence enabling a reliable and cost-efficient solution in this regard.

The mode setting portion 134 may be configured to pass the information indicating the selected lighting program directly to the control portion 136. Alternatively or additionally, the mode setting portion 134 may be configured to store the information indicating the selected lighting program in a memory, e.g. in the memory 138 for subsequent use by the control portion 138. The mode setting portion 134 may be further configured to keep information regarding a predetermined number of most recently selected lighting programs or to keep information regarding the selected lighting programs during a time window of predetermined duration. Such history information regarding the selected lighting programs may be subsequently employed e.g. by the mode setting portion 134 as part of future lighting program selection decisions. The information indicating the selected lighting program may be provided and/or stored together with information indicating the time of the respective selection having been made.

The control portion 136 is configured to control the operation of the respective one or more light sources 140, 140' in accordance with the most recently selected lighting program. As an example in this regard, the control portion 136 may be configured to drive the respective one or more light sources 140, 140' to provide light intensity according to the information defining the desired light intensity profile as a function of time in response to operating power being supplied to the driver 130, 130', i.e. in response to an active period. In this regard, driving the one or more light sources 140, 140' may comprise controlling provision or supply of the operating power received at the driver 130, 130' to the respective one or more light sources 140, 140' resulting in the respective desired light intensity.

As an example, in case of a LED light source predetermined electric current is typically required to cause the LED light source to provide its maximum (i.e. 100%) light intensity. Instantaneous light intensity provided by the LED light source is typically directly proportional to the electric current supplied thereto, and hence providing a desired percentage of the predetermined electric current to a LED light source serves to control the LED light source to provide a corresponding percentage of its maximum light intensity. As another example, a LED light source may be controlled by supplying the predetermined electric current required to cause the LED light source to provide its maximum light intensity intermittently, such that the periods of time during which the electric current is supplied to the LED constitute a desired percentage of time. Consequently, if the periods of time during which the electric current is supplied to the LED light source are sufficiently short, this results in the perceived light intensity from the LED light source to exhibit the corresponding percentage of its maximum light intensity. Typically, periodic switching at 200 Hz or above is applied to ensure that a human vision does not perceive the on/off switching of the LED light source as flickering of light.

A lighting program defines desired characteristics of light to be provided by the respective one or more light sources 140, 140' as a function of time. Hence, a lighting program may be also referred to e.g. as an operating mode, an operating profile or a lighting profile defining the desired temporal variations in characteristics of the light to be provided by the respective one or more light sources 140, 140'. Information defining the characteristics of light according to a lighting program may be stored, for each of the plurality of lighting programs, to a memory, e.g. to the memory 138. Preferably, the plurality of lighting programs is pre-stored in the driver 130, 130'.

Without losing generality, a lighting program may be divided into one or more segments, and information defining the characteristics of a lighting program may be arranged into information units or information elements, each of which defining desired characteristics of light determined for the corresponding segment of the lighting program. Each information unit/element, and hence the corresponding segment, is preferably also provided with timing information defining the duration of the segment and the timing of the segment with respect to a common reference point and/or with respect to one or more other segments of the lighting program. The common reference point may be e.g. the beginning of the light program or the end of the light program, and the timing information may comprise information that defines the starting time and/or the ending time of the segment with respect to the reference point. Instead of or in addition to applying a common reference point, the starting and/or ending time(s) of a given segment may be defined with respect to the starting/ending time of another segment of the lighting program, e.g. the segment immediately preceding or the segment immediately following the given segment.

The information defining the characteristics of light for a lighting program may comprise information defining the desired light intensity to be provided by the one or more light sources 140 as a function of time. Such information may be provided e.g. a series of light intensity values, e.g. in range from 0 to 100% of the maximum light intensity of the respective light sources 140, each value defining the desired light intensity for the respective time period, the series of the light intensity values covering the desired duration of the lighting program. Hence, a light intensity value may be considered as the information unit/entity defining the lighting characteristics for the corresponding segment of the lighting program.

As another example, the information defining the desired light intensity information for a lighting program may be provided as a series of value pairs, where a first value of a pair defines the desired light intensity, e.g. in range from 0 to 100% of the maximum light intensity of the respective light sources 140 while a second value of the pair defines fraction of the total duration of the lighting program for which the light intensity according to the first value of the pair is to be provided, thereby defining a relative duration of the light intensity to be provided in accordance with the first value of the pair. The value pairs may be provided as an ordered series, thereby providing the information units/elements constituting the lighting program. Alternatively or additionally, each value pair may be further provided with timing information as described hereinbefore, e.g. with timing information that defines the starting time of the segment of the lighting program corresponding to the respective segment with respect to the beginning of the lighting program or with respect to the end of the lighting program. As an example in this regard, a lighting program may define e.g. to keep the lights on at maximum light intensity for a segment covering the first 40% of the overall duration of the lighting program, to keep the lights on at 80% of the maximum light intensity for a segment covering the last 25% of the overall duration of the lighting program and to keep the lights off during the remaining segment between these two segments covering the remaining 35% of the overall duration of the lighting program.

As a variation of the previous example, instead of defining desired static light intensity, a value pair may define a transition from first light intensity level to a second light intensity level during the period defined for the value pair. The transition may be defined as a linear transition or a transition to be carried out using another predetermined pattern.

The examples regarding the information that may be applied to define a lighting program described hereinbefore apply the intensity of light as an example of the characteristics of light that may be defined by the lighting program.

However, the examples are applicable for representing information defining other characteristics of light in addition to or instead of light intensity, e.g. color of light and/or color temperature of light to be provided by one or more light sources 140.

Figure 3:
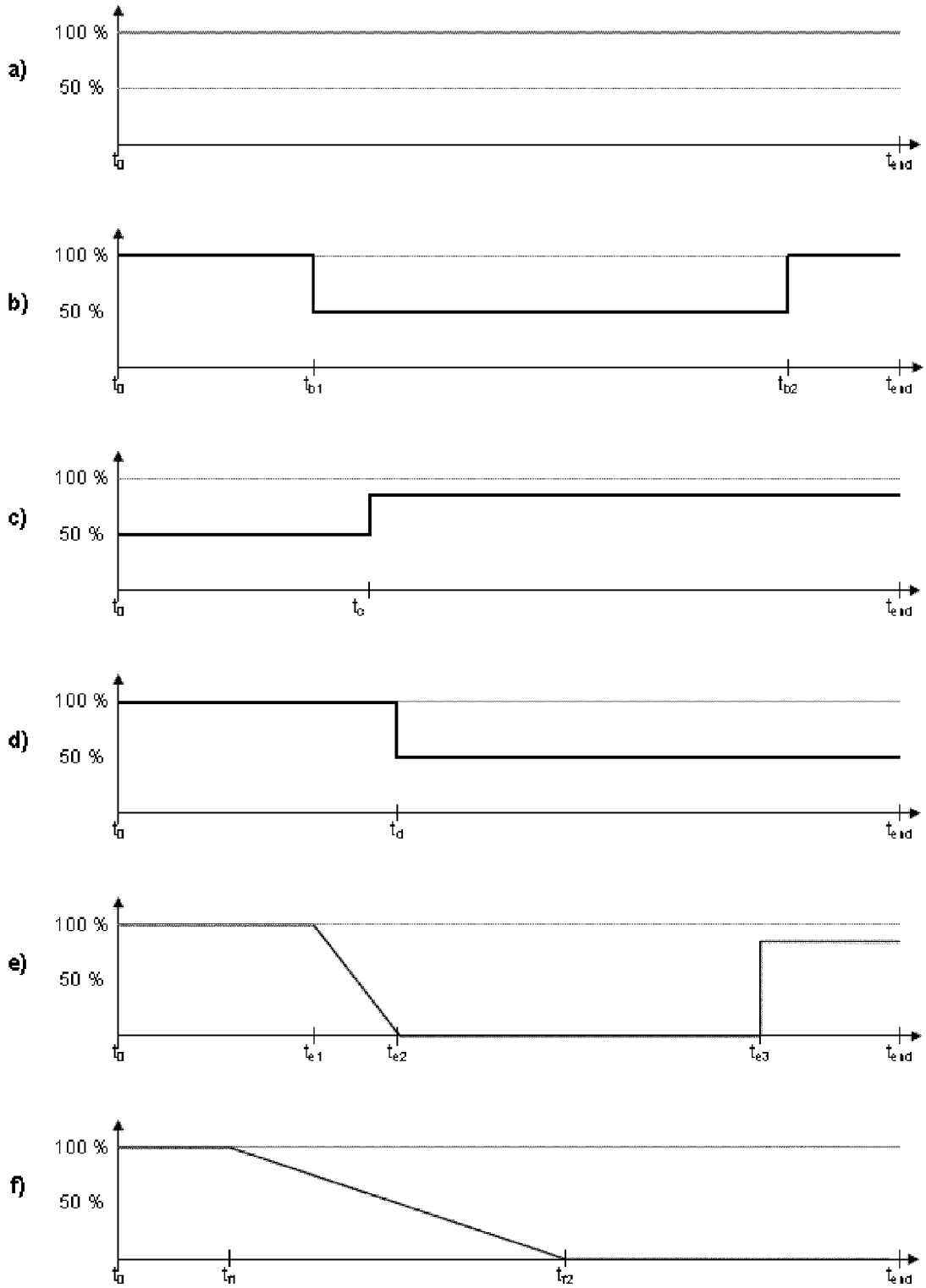
FIG. 3 illustrates exemplifying lighting programs in accordance with an example embodiment.

Some examples of lighting programs that define desired light intensity characteristics as a function of time are provided in FIG. 3. The lighting programs a) through g) illustrated in FIG. 3 serve as non-limiting examples of lighting programs that define the desired relative light intensity as a function of time, as indicated by the respective bold lines. In FIG. 3 $t_0$ denotes the starting time of a lighting program and $t_{end}$ denotes the end of a lighting program.

The lighting program a) defines the maximum light intensity (100%) to be provided throughout the lighting program. This lighting program may be considered to comprise a single segment providing 100% light intensity throughout the lighting program.

The lighting program b) defines 100% light intensity to be provided from the beginning of the lighting program until time $t_{b1}$ (a first segment), half of the maximum light intensity (50%) to be provided from time $t_{b1}$ until time $t_{b2}$ (a second segment) and 100% light intensity to be provided from time $t_{b2}$ until the end of the lighting program (a third segment).

The lighting program c) defines 50% light intensity to be provided from the beginning of the lighting program until time $t_c$ (a first segment) and 80% of the maximum light intensity to be provided from time $t_c$ until the end of the lighting program (a second segment).

The lighting program d) defines 100% light intensity to be provided from the beginning of the lighting program until time $t_d$ (a first segment) and 50% light intensity to be provided from time $t_d$ until the end of the lighting program (a second segment).

The lighting program e) defines 100% light intensity to be provided from the beginning of the lighting program until time $t_{e1}$ (a first segment), the light intensity to be gradually dimmed from 100% light intensity to the 0% light intensity (i.e. switching the lights off) during the period from time $t_{e1}$ to time $t_{e2}$ (a second segment), the lights to be kept off from time $t_{e2}$ until time $t_{e3}$ (a third segment) and 80% light intensity to be provided from time $t_{e3}$ until the end of the lighting program (a fourth segment).

The lighting program f) defines 100% light intensity to be provided from the beginning of the lighting program until time $t_{f1}$ (a first segment), the light intensity to be gradually dimmed from 100% light intensity to the 0% light intensity (i.e. switching the lights off) during the period from time $t_{f1}$ to time $t_{f2}$ (a second segment) and the lights to be kept off from time $t_{f2}$ until the end of the lighting program (a third segment).

As described hereinbefore, the time instants referred to in the example lighting programs a) to f) may be defined e.g. as absolute time since the beginning or the program or as absolute time before the end of the lighting program. Hence, for example the time instant $t_{b1}$ may be defined to occur e.g. at "$t_{b1}$ hours/minutes/seconds since the beginning of the lighting program" and the time instant $t_{b2}$ may be defined to occur e.g. at "$t_{b2}$ hours/minutes/seconds before the end of the lighting program. As another example, the time instant $t_c$ may be defined to occur e.g. at "$t_c$ hours/minutes/seconds since the beginning of the lighting program" or at "$t_c$ hours/minutes/seconds before the end of the lighting program".

Alternatively, as also described hereinbefore, the time instants may be defined in relation to the total duration of the lighting program. As an example in this regard, the time instant $t_{b1}$ may be defined to occur e.g. at "25% of the total duration of the lighting program since the beginning of the lighting program" and the time instant $t_{b2}$ may be defined to occur at "15% of the total duration of the lighting program before the end of the lighting program". As another example, the time instant $t_c$ may be defined to occur e.g. at "32% of the total duration of the lighting program since the beginning of the lighting program" or at "68% of the total duration of the lighting program before the end of the lighting program".

Basically the control portion 136 is configured to terminate the lighting program it is currently applying in response to completion the active period that triggered initiation of the lighting program. A lighting program may be provided with information defining its duration, possibly stored together with the other information defining the lighting program in a memory, e.g. in the memory 138. A lighting program may be further provided with information defining the action to be taken upon reaching the end of the lighting program indicated by the duration thereof. A few examples in this regard are described in the following.

A lighting program may be defined, for example, as a lighting program that has a predetermined default duration that can be changed, as will be described by examples in more detail hereinafter. Hence, a lighting program may have an adjustable or programmable duration. As a further example, a lighting program may be defined as an open-ended lighting program that defines the lighting characteristics at the end of the lighting program to be continued until completion of the active period that triggered initiation of the lighting program or until receiving an explicit control signal or other indication terminating the lighting program. Consequently, the control portion 136 may be configured to continue driving the respective one or more light sources 140, 140' using the lighting characteristics applied at the end of the lighting program until instructed otherwise.

In case a lighting program has no explicit duration defined therefor, the control portion 136 may be configured to determine an estimated duration of the lighting program on basis of one or more completed active periods. The estimated duration may be defined e.g. as the duration of the most recently completed active period or as an average of the durations of a predetermined number of most recently completed active periods. The determination of the estimated duration may consider all completed active periods or the determination may consider only completed active periods that have duration exceeding a predetermined threshold duration.

The control portion 136 may be configured to use the predefined or estimated duration of a lighting program in order to determine time instants that are defined with respect to the beginning of the lighting program, e.g. a starting time and/or an ending time for one or more segments of the lighting program defined to cover predetermined percentages of the total duration of the lighting program.

Along similar lines, the control portion 136 may be configured to use the predefined or estimated duration of a lighting program to determine time instants that are defined with respect to the end of the lighting program, e.g. a starting time or an ending time of a segment of the lighting program at predetermined number of hours/minutes/seconds before the end of the lighting program, a starting time and/or an ending time for one or more segments of the lighting program defined to cover predetermined percentages of the total duration of the lighting program, e.g. a starting time for a segment covering a predetermined percentage of the total duration of the lighting program at the end of the lighting program.

Alternatively or additionally, the control portion 136 may be configured apply the estimated duration for terminating a lighting program that has no predefined duration assigned therefor: the control portion 136 may be configured to terminate the lighting program in response to the estimated duration after commencing the lighting program having elapsed.

The driver 130, 130' may be provided with a default lighting program. The default lighting program may be employed e.g. as an initial lighting program that is to be applied by the control portion 136 before the first selection of a lighting program has been carried out by the mode setting portion 134. The default lighting program may also be the lighting program to be applied (e.g. selected) in case of a malfunction of the driver 130, 130' or in case there is any confusion or uncertainty about the correct lighting program. The default lighting program is preferably a lighting program that provides lighting characteristics that ensure sufficient level of lighting in all operating conditions. The default lighting program may be a special-purpose lighting program that cannot be selected on basis of the observed duration of the active period(s) or the default lighting program may be one of the plurality of lighting programs from which the lighting program to be applied is selected in accordance with the observed durations of active period(s). As an example, the lighting program a) illustrated in FIG. 3 is a lighting program suitable as the default lighting program.

The control portion 136 may be configured terminate the currently applied lighting program in response to the duration of the currently applied lighting program having exceeded the defined or estimated duration of the lighting program by at least a predetermined margin. Such a margin may be defined as an absolute time, e.g. as a suitable value in the range from 30 min to 2 hours, or as a percentage of the defined/estimated duration, e.g. as a suitable percentage in the range from 5% to 25%. The control portion 136 may be further configured to, immediately after termination of the lighting program, to control switching the lights to the maximum light intensity or to commence execution of the default lighting program.

The control portion 136 may be configured to terminate application of the currently selected lighting program and to start applying the default lighting program in response to a predetermined sequence of active periods. Such predetermined sequence is preferably defined such that it is extremely unlikely to occur in normal operating conditions. As an example, such a sequence may comprise a predetermined number of short interruptions in power supply during an active period with a fixed time period in-between, e.g. three interruptions of less than one second with a period of 3 seconds therebetween.

The mode setting portion 134 may be configured to select the lighting program among the plurality of lighting programs in accordance with duration of a single active period. In particular, the mode setting portion 134 may be configured to interpret an active period having duration that is shorter than a threshold duration $Th_p$ as a control signal intended to indicate the desired lighting program for the driver 130, 130'. In other words, the active period having duration not exceeding the threshold duration $Th_p$ may serve as a program setting period. Alternatively, instead of merely considering an upper limit of duration, i.e. the threshold duration $Th_p$, the mode setting portion 134 may consider an active period having duration in the range from $Th_{p0}$ to $Th_p$ as a program setting period. The value of the threshold $Th_{p0}$ may be e.g. in the range 2 to 10 seconds and the value of the threshold $Th_p$ may be e.g. in the range from 20 to 120 seconds, depending e.g. on the number of available lighting programs. However, these values serve as non-limiting examples and threshold values outside the exemplifying ranges may be applied.

Once the program setting period is completed and the mode setting portion 134 has selected the lighting program accordingly, the control portion may be configured to apply the selected lighting program in response to a subsequent active period, e.g. the active period immediately following the program setting period and/or to any active period following the most recent program setting period until detecting a subsequent program setting period.

Preferably, the control portion 136 is configured to refrain from providing operating power to the respective one or more light sources 140, 140' in response to an active period not exceeding the threshold duration $Th_p$, thereby avoiding unnecessarily turning on the lights for a short period of time in response to a period of operating power supplied to the driver 130, 130' with the purpose of selecting the desired lighting program for a subsequent active period exceeding another threshold duration $Th_L$ In other words, the control portion 136 may be configured to provide operating power to the respective one or more light sources 140, 140' only in response to an active period having duration that exceeds the threshold duration $Th_L$. Such active period exceeding the threshold duration $Th_L$ is hence treated as a lighting period. The threshold duration $Th_L$ is longer than or equal to the threshold duration $Th_p$. Consequently, the value selected for the threshold $Th_L$ depends on the value of the threshold $Th_p$, and may be e.g. set to a value $Th_L=Th_p+T_{margin}$, where the value of $T_{margin}$ may be selected e.g. from the range from 0 to 10 seconds.

The threshold duration $Th_L$ may be further applied as the predetermined duration serving as the lower limit for duration of a completed active period considered in determination of the estimated duration of a lighting program, as described hereinbefore.

Alternatively, the control portion 136 may be configured to provide operating power to the respective one or more light sources 140, 140' according to the most recently selected lighting program in response to any active period regardless of its duration. Hence, in this scenario each active period is considered as a lighting period, whereas a short active period falling short of the threshold duration $Th_p$ is additionally considered as a program setting period. While this approach contributes towards avoiding unnecessary delays in switching on the lights in response to supplying operating power to the driver 130. 130', it may result in unnecessary blinking of lights in case the active period is primarily provided as a program setting period that is terminated before its duration reaching the threshold duration $Th_p$.

The mode setting portion 136 may be configured to select the lighting program for a subsequent lighting period on basis of the duration of the program setting period, i.e. on basis of the duration of a single active period having duration that does not exceed the threshold duration $Th_p$. In this regard, the timeline below the threshold duration $Th_p$ may be divided into two or more sub-ranges, where each sub-rage is associated with a single lighting program of the plurality of lighting programs. The sub-ranges are non-overlapping, and they are preferably defined as adjacent sub-ranges such that an upper limit of a given sub-range equals to the lower limit of the next higher sub-range.

An example of sub-ranges is provided in the first column of Table 1 with the second column of Table 1 indicating the lighting program (with reference to the lighting programs a) to f) of the example provided in FIG. 3) associated with the respective sub-range.

TABLE 1

| Program setting period | Lighting program |
|---|---|
| <10 seconds | Program a) |
| 10-20 seconds | Program b) |
| 20-30 seconds | Program c) |
| 30-40 seconds | Program d) |
| 40-50 seconds | Program e) |
| 50-60 seconds | Program f) |

The mode setting portion 134 may be configured to determine the sub-range within which the duration of the program setting period falls and to select the lighting program associated with the sub-range so determined. Hence, in the example of Table 1 the mode setting portion 134 is configured to select, in response to an active period that is shorter than or equal to 60 seconds one of the lighting programs a) to f) in accordance with the duration of the active period. Consequently, the control portion 136 applies the selected lighting program in response a subsequent lighting period.

In a variation of the example described in context of Table 1, the sub-ranges are not defined as adjacent sub-ranges but a gap between two consecutive sub-ranges is provided. An example of sub-ranges of such type is provided in Table 2.

TABLE 2

| Program setting period | Lighting program |
|---|---|
| 5-10 seconds | Program a) |
| 15-20 seconds | Program b) |
| 25-30 seconds | Program c) |
| 35-40 seconds | Program d) |
| 45-50 seconds | Program e) |
| 55-60 seconds | Program f) |

Hence, in the example of Table 2 the mode setting portion 134 is configured to select, in response to an active period that is shorter than or equal to 60 seconds one of the lighting programs a) to f) in accordance with the duration of the active period provided that the duration of the active period falls within one of the ranges defined in Table 2.

In case the duration of the active period that is shorter than 60 seconds falls outside the sub-ranges of Table 2, the program selection may be considered as undefined and the most recently selected mode is to be applied for a subsequent lighting period. Alternatively, the mode selection portion 134 may be configured to change to the default lighting program in response to the duration of the active period falling within one of the undefined sub-ranges. Such active periods that are shorter than 60 seconds but fall outside the sub-ranges of Table 2 may be employed e.g. to issue mode selection commands to other drivers without affecting the operation or mode selection of the driver 130, 130'. As an example in this regard, e.g. in the exemplifying arrangement 100', or in any arrangement where a single switching entity 120 is feeding two or more drivers 130, 130', the driver 130 (or the mode selection portion 134 thereof) may be configured to select the lighting program in accordance with Table 2, whereas the driver 130' (or the mode selection portion 134 thereof) may be configured to select the lighting program in accordance with Table 3.

TABLE 3

| Program setting period | Lighting program |
|---|---|
| <5 seconds | Program a) |
| 10-15 seconds | Program b) |
| 20-25 seconds | Program c) |
| 30-35 seconds | Program d) |
| 40-45 seconds | Program e) |
| 50-55 seconds | Program f) |

While typically the plurality of lighting programs are defined as static lighting programs that cannot be changed, modified or adjusted once provided to the driver 130, 130', the mode setting portion 134 may be configured to modify or adjust at least one characteristics of one or more of the plurality of lighting programs in accordance with a control signal. As an example, such a control signal may comprise one or more active periods following a program setting period, referred to in the following as program adjustment period(s). The mode setting portion 134 may be configured to modify at least one characteristics or parameter of one or more of the plurality of lighting programs in accordance with durations of the one or more program adjustment period. Hence, the modification of a lighting program may be triggered by reception of two or more (consecutive) active periods in accordance with durations thereof, the first one causing the mode setting portion 134 to set the driver 130, 130' into a program adjustment mode of operation and the second and possible further ones determining the characteristics and scope of the program adjustment to be applied.

As an example in this regard, one or more predetermined sub-ranges of the mode setting period may be associated with a program adjustment mode of operation while the other sub-ranges may be associated with the lighting programs from a) to f), along the lines described in context of Table 1. A concrete example for such a scenario is provided in Table 4 that may be applied to extend e.g. Table 1, Table 2 or Table 3.

Hence, in the example of Table 4 the mode setting portion 134 is configured to select, in response to an active period that is shorter than or equal to 200 seconds, either one of the lighting programs a) to f) in accordance with the duration of the active period provided that the duration of the active period falls within one of the ranges defined in Table 1, Table 2 or Table 3 or one of the program adjustment modes in case the duration of the active period interpreted as the program setting period has a duration that falls within one of the sub-ranges defined in Table 4 covering the durations from 60 to 240 seconds. In case the duration of the active period indicates selection of one of the lighting programs, the operation continues with the control portion 136 applying the selected lighting program in response to a subsequent lighting period. In case the duration of the active period indicates entry into one of the program adjustment modes, one or more active periods to be interpreted as program adjustment periods will follow, and the mode setting portion 134 is configured to adjust characteristics of at least one of the plurality of lighting programs in accordance with the durations of the one or more program adjustment period.

TABLE 4

| Program setting period | Adjustment operation |
|---|---|
| 60-70 seconds | Next command will give new max light level for all lighting programs |
| 70-80 seconds | Next command will give new min light level for all lighting programs |
| 80-90 seconds | Adjust light levels of lighting program a) |
| 90-100 seconds | Adjust light levels of lighting program b) |
| 100-110 seconds | Adjust light levels of lighting program c) |
| 110-120 seconds | Adjust light levels of lighting program d) |
| 120-130 seconds | Adjust light levels of lighting program e) |
| 130-140 seconds | Adjust light levels of lighting program f) |
| 140-150 seconds | Reprogram segment durations of lighting program a) |
| 150-160 seconds | Reprogram segment durations of lighting program b) |
| 160-170 seconds | Reprogram segment durations of lighting program c) |
| 170-180 seconds | Reprogram segment durations of lighting program d) |
| 180-190 seconds | Reprogram segment durations of lighting program e) |
| 190-200 seconds | Reprogram segment durations of lighting program f) |

New light levels and/or segment durations for the lighting programs selected for adjustment or reprogramming are determined in accordance with durations of the subsequent one or more active period(s), e.g. as defined by an example in Table 5.

TABLE 5

| Program adjustment period | Selection for intensity or duration |
|---|---|
| <5 seconds | 0% |
| 5-10 seconds | 10% |
| 10-15 seconds | 20% |
| 15-20 seconds | 30% |
| 20-25 seconds | 40% |
| 25-30 seconds | 50% |
| 30-35 seconds | 60% |
| 35-40 seconds | 70% |
| 40-45 seconds | 80% |
| 45-50 seconds | 90% |
| 50-55 seconds | 100% |

Hence, the duration of a given program adjustment period may be used to indicate a desired reprogrammed/adjusted light intensity (as a percentage of the maximum light intensity) or the duration (as a percentage of the overall duration of the lighting program). A few examples of possible program adjustment periods that may be associated with the exemplifying programming approaches listed in Table 4 are provided in the following.

The first two examples of Table 4 affect all lighting programs and hence duration of a single program adjustment period is used to indicate the new maximum or minimum light intensity level for all lighting programs e.g. in accordance with Table 5.

The third to eighth examples of Table 4 affect light levels of segments of the respective lighting programs. Consequently, the number of program adjustment periods that follow the program setting period causing entry to the program adjustment mode of operation is the same as the number of segments in the respective lighting program, with duration of each program adjustment period defining the reprogrammed light intensity for the respective segment of the lighting program under adjustment.

The ninth to fifteenth examples of Table 4 affect durations of segments of the respective lighting programs. Consequently, the number of program adjustment periods that follow the program setting period causing entry to the program adjustment mode of operation is the same as the number of segments in the respective lighting program, with duration of each program adjustment period defining the reprogrammed duration for the respective segment of the lighting program under reprogramming.

This way, light levels and/or durations of lighting program segments may be practically freely adjusted e.g. to provide a fit with changing operating conditions e.g. due to changes in the amount of daylight changing over the year or to otherwise adjust/reprogram the lighting programs to provide different behavior. As an example in this regard, for summer time the maximum light output can be set to 70% to save energy, while for the winter time the maximum output can be set (back) to 100% to ensure sufficient illumination. If the reprogrammed durations of segments of a lighting program do not sum up to 100% they can be automatically adjusted so that they do, preferably by preserving the relationship between the reprogrammed segment durations.

The mode setting portion 134 may be configured to adjust the selected lighting program or all lighting programs by modifying the information defining the characteristics of the respective lighting program(s) stored in a memory, e.g. in the memory 138, accordingly. The mode setting portion 134 may be configured to keep a copy of the original information defining the characteristics of the lighting programs and apply all possible modifications to working copies thereof to ensure that the original lighting programs may be restored by resetting the driver 130, 130' e.g. in case of a malfunction or error state of the driver 130, 130'.

For example in the exemplifying arrangement 100', or in any arrangement where a single switching entity 120 is applied to feed operating power to two or more drivers 130, 130', both drivers 130, 130' may be configured to select the lighting program in response to the same program selection period. As an example, the driver 130 and the driver 130' may both apply similar selection rule, e.g. the one exemplified in Table 1, Table 2 or Table 3. Alternatively, the driver 130 and the driver 130' (and possible further drivers) may be configured to apply different selection rules in response to the same program selection period. As an example in this regard, the selection rule may result in selection of a different lighting program from the same or similar set of plurality of lighting programs at the driver 130 and the driver 130' in response to the same program setting period. As another example, some or all of the lighting programs available at the driver 130 may be different from those available at the driver 130'. Such arrangements may enable e.g. employing a single control entity 110 and/or a single switching entity 120 to control lighting for environments of different lighting requirements.

The mode setting portion 136 may be configured to select the lighting program for a subsequent lighting period on basis of the duration of the preceding lighting period, hence without a need to apply or issue dedicated program setting periods. Such an approach may be beneficial e.g. in an arrangement where a single switching element 120 is employed to control supply of operating power both to drivers 130, 130' that are capable of applying one of a plurality lighting programs and to legacy drivers that are not at all capable of selecting lighting programs or drivers that apply other techniques for selecting a lighting program. This may be especially beneficial in scenarios where the same switching element 120 is supplying operating power both to one or more drivers 130, 130' and to a legacy driver that is driving e.g. one or more HID lamps, such as sodium vapor lamps or mercury vapor lamps, that are likely to suffer from short active periods of operating power supplied thereto.

Hence, as an alternative to applying a dedicated program setting period not exceeding the threshold duration $Th_p$, the mode setting portion 134 may be configured to select the lighting program among the plurality of lighting programs in accordance with duration of the most recent lighting period. Thus, in this scenario the lighting period—or a portion thereof—simultaneously serves as the program setting period. As an example in this regard, the mode setting portion 134 may be configured to apply a predetermined divisor and to determine or compute the remainder of the duration of a preceding completed active period divided by the predetermined divisor. The preceding completed active period may be the most recently completed active period or the most recent completed active period that exceeds a threshold duration $Th_m$. Consequently, the remainder of the above-mentioned division may serve as the program setting period, and the lighting program may be selected as described hereinbefore in context of the dedicated program setting period, e.g. according to one of the Tables 1, 2 or 3. As an example in this regard, one may consider the divisor to be 10 minutes and the duration of the most recent completed lighting period to be 8 hours 12 minutes, resulting in the remainder value 2 minutes that hence serves as the program setting period.

For example in a scenario where a driver 130, 130' relying on dedicated program setting periods is applied in an arrangement where a single switching element 120 is employed to control supply of operating power both to one or more drivers 130, 130' that are capable of applying one of a plurality lighting programs and to one or more legacy drivers that are not able to select a lighting program in response to the program setting period, it may be advantageous to supply the operating power from the switching element 120 to a legacy driver via a filter entity configured to exclude the program setting periods from the operating power supplied to the legacy driver. In particular, such a filter entity may be configured to provide operating power supplied thereto further to the respective legacy driver only in response to duration of an active period of operating power exceeding the threshold duration $Th_L$, thereby avoiding unnecessary blinking of light of light source(s) controlled by the legacy driver. Such a filter entity may be of particular advantage in a scenario where the legacy drivers are arranged to control light source types that are likely to suffer from short active periods of operating power supply.

The control entity 110 may be provided with an arrangement that enables issuing control signals to the switching entity 120 to, consequently, cause the switching entity 120 to supply continuous periods of operating power of desired duration to the driver 130, 130' in order to control selection of a lighting program accordingly. As an example, such control signals may be issued by a user manually operating a user-operable switch. As another example, the control entity 110 may be provided with a user interface that allows partially automated issuance of control signals, e.g. by providing a one or more physical push buttons, each of which is arranged to issue control signal(s) that result in a continuous period of operating power resulting in the driver 130, 130 selecting the respective lighting program. As a further example, instead of physical push buttons suitable computer software providing the push buttons or a corresponding arrangement as a graphical user interface on a display of a computer may be employed to provide the desired control signal(s) to control lighting program selection.

Figure 4:
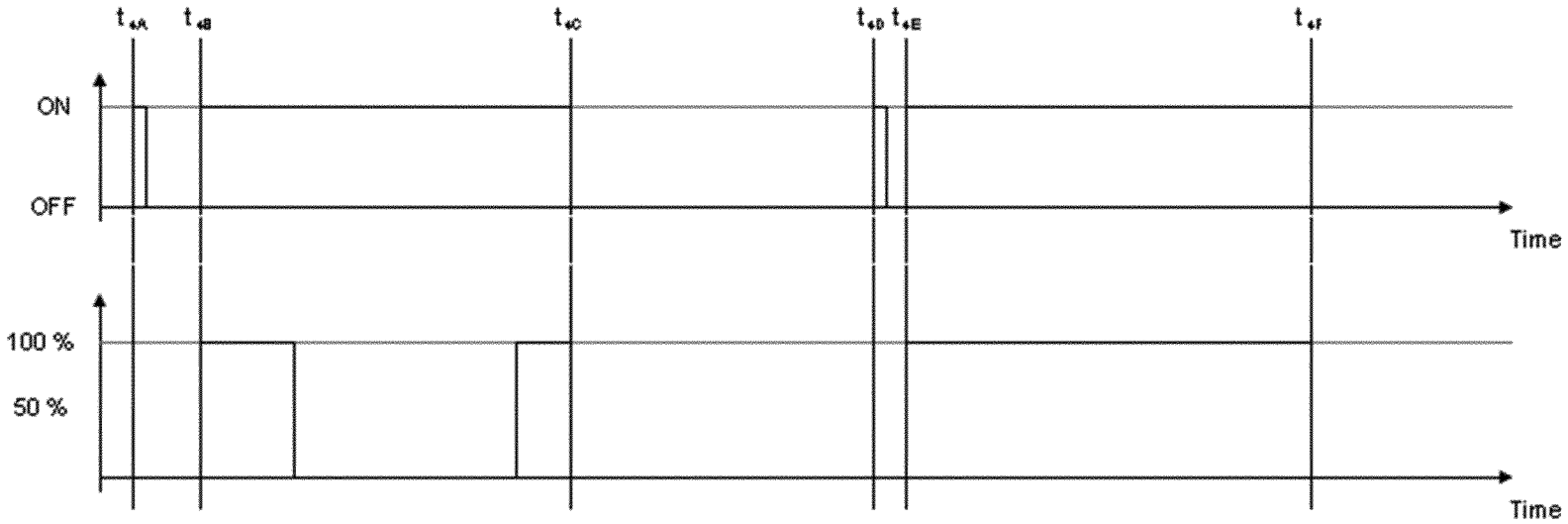
FIG. 4 illustrates an example of selecting lighting programs in accordance with an example embodiment.

In order to further illustrate some concepts described in greater detail in the foregoing, an example of applying a dedicated program setting period for selecting a lighting program is provided with reference to FIG. 4. The upper diagram of FIG. 4 illustrates the periods of operating power supplied to the driver 130, 130' and the lower diagram of FIG. 4 exemplifies the resulting light intensity.

Starting at time $t_{4A}$, operating power is supplied to the driver 130, 130' for a short period of time, and this period is interpreted as a program setting period. Consequently, the driver 130, 130' does not control switching the lights on but selects a lighting program corresponding to the duration of the program setting period to be applied during a subsequent lighting period. Subsequently, in response to a longer period of operating power being supplied to the driver 130, 130' commencing at time $t_{4B}$ and ending at time $t_{4C}$, interpreted as a lighting period, the driver 130, 130' applies the selected lighting program from time $t_{4B}$ until time $t_{4C}$, hence loosely corresponding to the lighting program b) illustrated in FIG. 3 and described hereinbefore. This active period of operating power input is initiated such that it covers the desired period of illumination, typically the night time when no daylight is available. The non-active period of operating power from time $t_{4C}$ to time $t_{4E}$, on the other hand, corresponds to a period daylight when no illumination is needed.

Starting at time $t_{4D}$, another short period of operating power is observed, interpreted as a program setting period for the lighting period covering the following night time. Again, the lighting program for the following lighting period is selected in accordance with duration of the program setting period, and the selected lighting program is applied during the period of operating power supplied to the driver 130, 130' starting at time $t_{4E}$ until time $t_{4F}$. This time the selected and applied lighting program corresponds to the lighting program a) illustrated in FIG. 3 and described hereinbefore.

Figure 5:
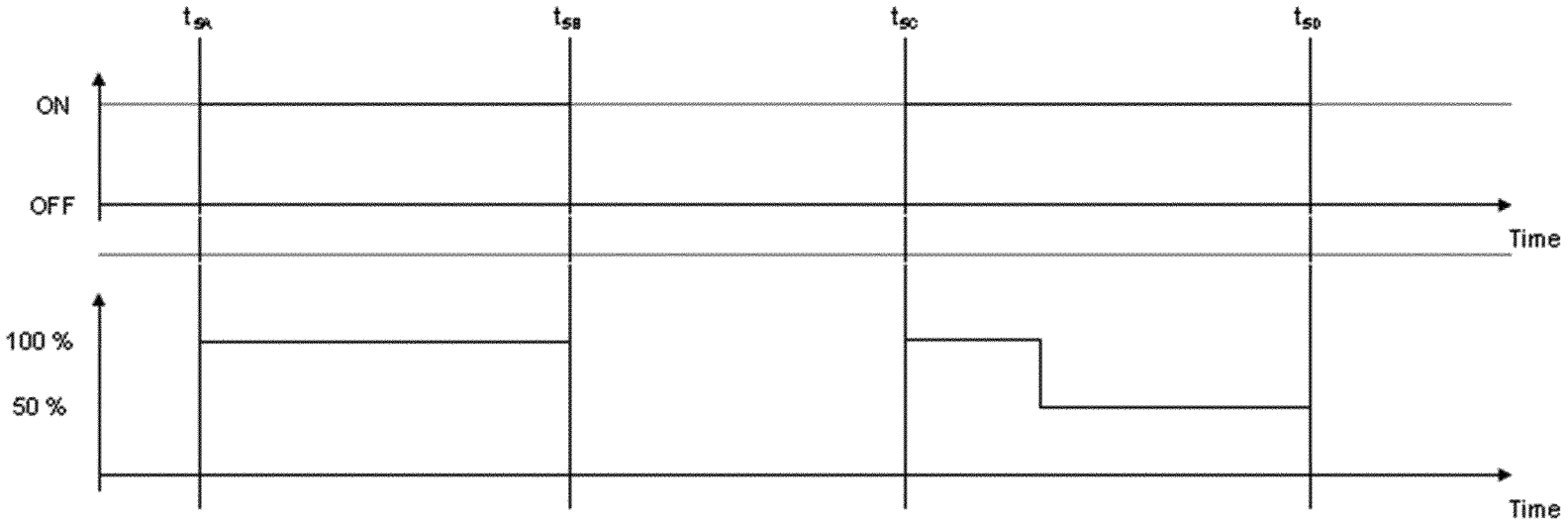
FIG. 5 illustrates an example of selecting lighting programs in accordance with an example embodiment.

Another example further illustrating some concepts described in greater detail in the foregoing is described with reference to FIG. 5. This example applies the most recent lighting period (also) as a mode setting period. As in case of FIG. 4, the upper diagram of FIG. 5 illustrates the periods of operating power supplied to the driver 130, 130' and the lower diagram of FIG. 5 exemplifies the resulting light intensity Starting at time $t_{5A}$, operating power is supplied to the driver 130, 130' until time $t_{5B}$, resulting in the lighting period from time $t_{5A}$ until time $t_{5B}$, during which the lighting program selected on basis of duration the most recent lighting period is applied. As in the example based on FIG. 4, also in this case the lighting period aims to cover the night time when no daylight is available. The lighting period from time $t_{5A}$ until time $t_{5B}$ applies a lighting program that corresponds to the lighting program a) illustrated in FIG. 3 and described hereinbefore. The following non-active period of operating power from time $t_{5B}$ to time $t_{5C}$, on the other hand, corresponds to a period daylight when no illumination is needed.

After completion of the lighting period at time $t_{5B}$, the duration of the lighting period is employed to select the lighting program for the following lighting period. In particular, the lighting program is selected on basis of the remainder of the duration of the lighting period from time $t_{5A}$ until time $t_{5B}$ divided by a predetermined quotient. Hence, in order to select the desired lighting program for the following lighting period, the duration of the lighting period from time $t_{5A}$ until time $t_{5B}$ was selected in view of the known value of the quotient in order to result in a desired value of the remainder—consequently resulting in selection of the desired lighting program.

After the non-active period of operating power, a second lighting period from time $t_{5C}$ until time $t_{5D}$ is provided in response to the period of operating power being supplied from time $t_{5C}$ until time $t_{5D}$, the second lighting period operating the selected lighting program loosely corresponding to the lighting program d) illustrated in FIG. 3 and described hereinbefore.

The operations, procedures and/or functions assigned to the structural units described in the context of the driver 130, 130', e.g. to the monitoring portion 132, to the mode setting portion 134 and to the control portion 136 may be divided between these portions in a different manner. Moreover, there may be further portions or units that are configured to perform some of the operations, procedures and/or functions assigned to the monitoring portion 132, to the mode setting portion 134 and to the control portion 136 as described hereinbefore. On the other hand, the operations, procedures and/or functions assigned to the monitoring portion 132, to the mode setting portion 134 and to the control portion 136 may be assigned to a single portion or to a single unit within the driver 130, 130' or within a driver apparatus.

In particular, the operations, procedures and/or functions described in context of the monitoring portion 132, to the mode setting portion 134 and to the control portion 136 may be provided as means for carrying out the corresponding operations, procedures and/or functions assigned to the respective portions of the client 130, 130'. Such means may be provided as software means, as hardware means, or as a combination of software means and hardware means. As an example, the driver 130, 130' may be provided as an apparatus for driving one or more light sources, the apparatus comprising means for observing durations of active periods, wherein an active period corresponds to a continuous period of operating power being supplied to the apparatus, means for selecting one of a plurality of lighting programs for the apparatus in accordance with the observed durations of one or more active periods, wherein a lighting program defines the desired characteristics of light provided by the one or more light sources as a function of time for a subsequent active period, and means for controlling, in response to an active period, provision of operating power from the apparatus to the one or more light sources in accordance with the most recently selected lighting program. The means may be provided as software means, as hardware means or as a combination of software means and hardware means.

Figure 6:
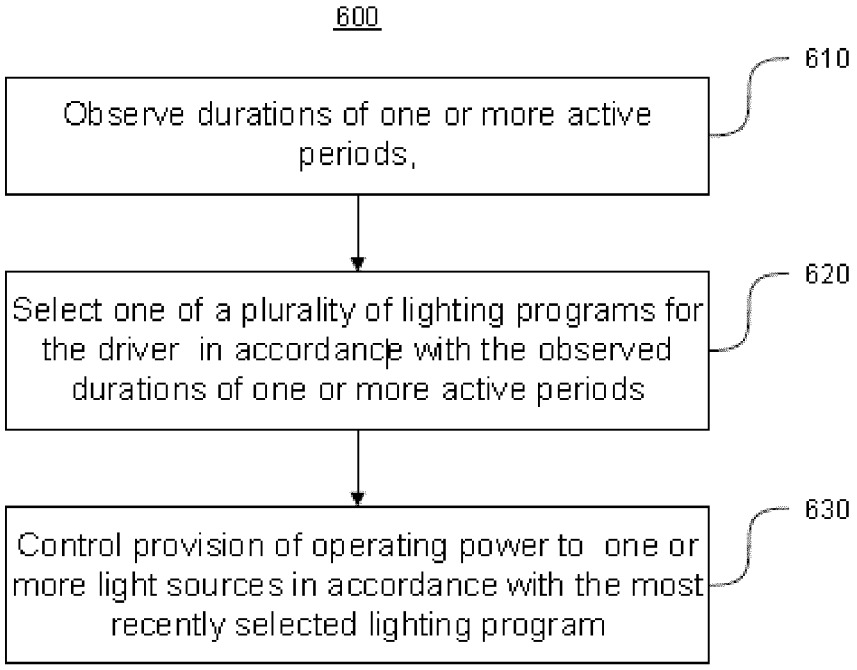
FIG. 6 illustrates a method in accordance with an embodiment of the present invention.

The operations, procedures and/or functions assigned to the structural units described in the context of the driver 130, 130', e.g. to the monitoring portion 132, to the mode setting portion 134 and to the control portion 136 may be provided as steps of a method. In this regard, FIG. 6 provides a flowchart illustrating a method 600 for driving one or more light sources, 140, 140'. The method 600 comprises observing durations of active periods, wherein an active period corresponds to a continuous period of operating power being supplied to the driver 130, 130', as indicated in block 610. The method 600 further comprises selecting one of a plurality of lighting programs for the driver 130, 130' in accordance with the observed durations of one or more active periods, wherein a lighting program defines the desired characteristics of light provided by the respective one or more light sources 140, 140' as a function of time for a subsequent active period, as indicated in block 620. The method 600 further comprises controlling, in response to an active period, provision of operating power from the driver 130, 130' to the respective one or more light sources 140, 140' in accordance with the most recently selected lighting program, as indicated in block 630.

As an example, the lighting program selection of block 620 may comprise selecting one of the available lighting programs in accordance with duration of a program setting period, wherein the program setting period is an active period having duration falling below the threshold duration $Th_p$ as described in more detail hereinbefore in context of the mode setting portion 134. As another example, the program setting period may be a portion of an active period, and the duration of the program setting period may be determined by computing the value of the remainder of the duration of a completed active period, e.g. the most recently completed active period, divided by a predetermined divisor, as described in more detail hereinbefore in context of the mode setting portion 134. A number of (further) variations to the method 600 may be applied according to the examples described hereinbefore in the context of the monitoring portion 132, to the mode setting portion 134 and to the control portion 136.

Figure 7:
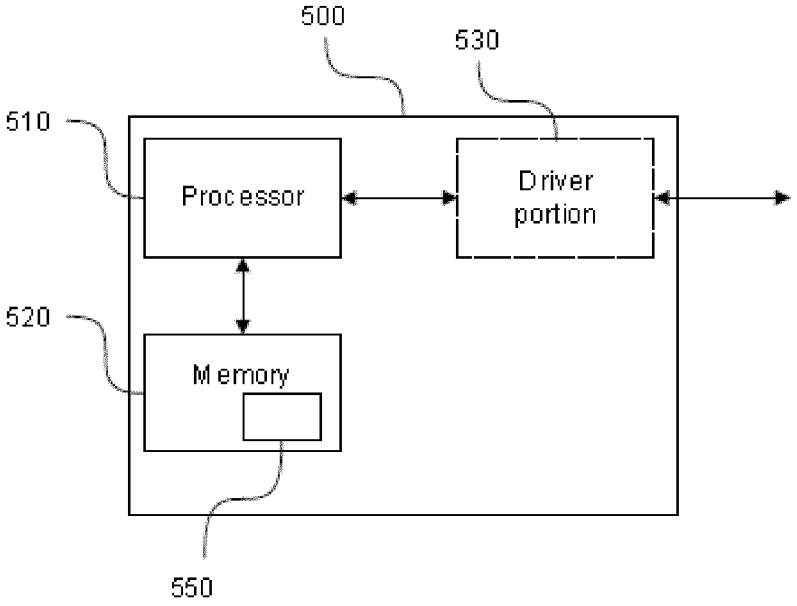
FIG. 7 schematically illustrates an apparatus in accordance with an example embodiment.

FIG. 7 schematically illustrates an exemplifying apparatus 500, e.g. a driver apparatus, that may be employed for embodying the driver 130, 130'. The apparatus 500 comprises a processor 510 and a memory 520, the processor 510 being configured to read from and write to the memory 520. The apparatus 500 may further comprise further structural units or portions, e.g. ones described hereinbefore in context of FIG. 2 with a reference the driver apparatus and a driver portion, represented in FIG. 5 as an optional driver portion 530.

Although the processor 510 is illustrated as a single component, the processor 510 may be implemented as one or more separate components. Although the memory 520 is illustrated as a single component, the memory 520 may be implemented as one or more separate components, some or all of which may be integrated/removable and/or may provide permanent/semi-permanent/dynamic/cached storage. The memory 520 may comprise the memory 138.

The apparatus 500 may be embodied as a special-purpose or as a general purpose device with a sufficient processing capacity. Preferably, however, the apparatus 500 is embodied as an apparatus dedicated for operating as the driver 130, 130' or as one or more portions thereof.

The memory 520 may store a computer program 550 comprising computer-executable instructions that control the operation of the apparatus 500 when loaded into the processor 510 and executed by the processor 510. As an example, the computer program 550 may include one or more sequences of one or more instructions. The computer program 550 may be provided as a computer program code. The processor 510 is able to load and execute the computer program 550 by reading the one or more sequences of one or more instructions included therein from the memory 520. The one or more sequences of one or more instructions may be configured to, when executed by one or more processors, cause an apparatus, for example the apparatus 500, to implement the operations, procedures and/or functions described hereinbefore in context of the driver 130, 130'.

Hence, the apparatus 500 may comprise at least one processor 510 and at least one memory 520 including computer program code for one or more programs, the at least one memory 520 and the computer program code configured to, with the at least one processor 510, cause the apparatus 500 to perform the operations, procedures and/or functions described hereinbefore in context of the driver 130, 130'.

The computer program 550 may be provided independently of the apparatus, and the computer program 550 may be provided at the apparatus 500 via any suitable delivery mechanism. As an example, the delivery mechanism may comprise at least one computer readable non-transitory medium having program code stored thereon, the program code which when executed by an apparatus cause the apparatus at least implement processing to carry out the operations, procedures and/or functions described hereinbefore in context of the driver 130, 130'. The delivery mechanism may be for example a computer readable storage medium, a computer program product, a memory device a record medium such as a CD-ROM, a DVD a Blue-ray Disc, a corresponding optical media, an article of manufacture that tangibly embodies the computer program 550, etc. As a further example, the delivery mechanism may be a signal configured to reliably transfer the computer program 550.

Figure 8:
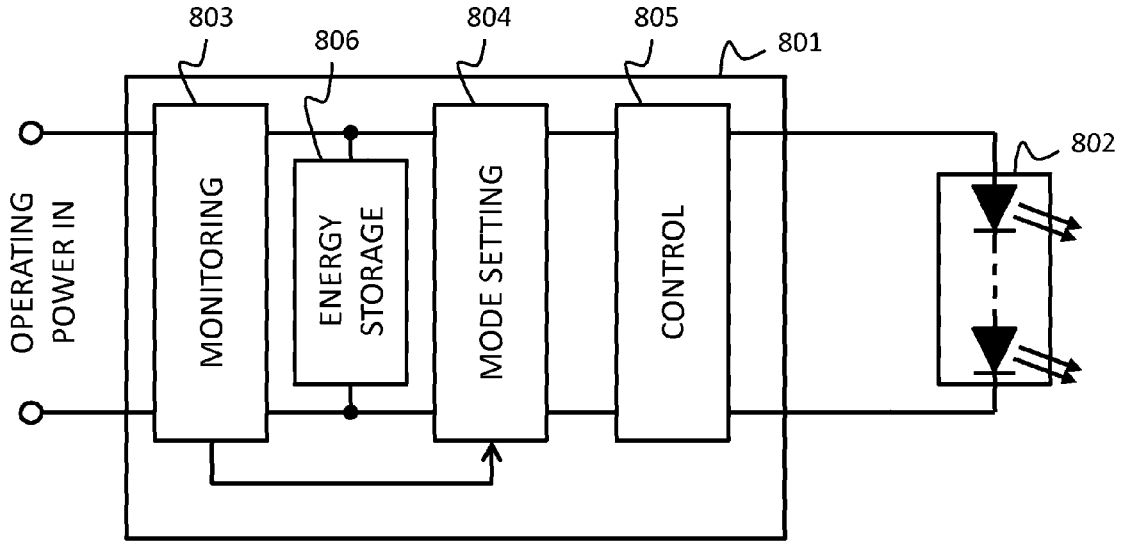
FIG. 8 schematically illustrates an apparatus in accordance with an example embodiment.

FIG. 8 illustrates an apparatus according to a further embodiment of the invention. The apparatus 801 is meant for driving one or more light sources 802. In addition to the monitoring portion 803, the mode setting portion 804, and the control portion 805, it comprises an energy storage 806 for temporarily storing electric energy. The energy storage 806 may be e.g. a capacitor, a supercapacitor, a battery, a rechargeable battery, or some other device that is capable of temporarily storing enough electric energy for the apparatus 801 to drive the one or more light sources 802 with energy taken from the energy storage 806 during an interruption between two consecutive active periods.

An apparatus according to the embodiment shown in FIG. 8 can be used in a system in which a control entity transmits commands and/or other information to drivers so that the commands and/or other information is encoded in at least one of:

- the length in time of one or more active periods,
- the length in time of one or more interruptions between active periods,
- the number of separate active periods that occur during a certain time interval and that are separated from each other by interruptions between them,
- the number of interruptions that occur during a certain time interval and that are separated from each other by active periods between them.

In other words, in a system of the kind described above, a control entity may use switching entities to switch on and off the operating power to the driver(s) of the light sources to be controlled, so that the way in which the switching takes place conveys a message to the driver(s), but so that the temporary interruptions in operating power do not become visible to a human user in the form of varying intensity of light. Energy taken from the energy storage in the driver(s) masks in each case the effect of a temporary interruption in operating power.

The capacity of the energy storage 806 in relation to the combined energy consumption of the light sources 802 and the electronic parts of the apparatus 801 dictates, how long temporary interruptions in operating power can be made up for without visible effects in the light output. It is assumed that for example the effect of interruptions in the order from about hundred milliseconds to several seconds could be masked without difficulty even with a relatively modestly dimensioned energy storage. Masking the effect of a temporary interruption is naturally the easier, the shorter the interruption was, but it may be advantageous to have a certain minimum length for intentional temporary interruptions of this kind in order not to confuse an intentional interruption with an unintended one that may have been caused by interference or transient effects in power distribution.

Using the length of active periods and/or interruptions to convey information to the apparatus 801 should not be confused with modern applications of phase-cut dimming. It is known to have e.g. an LED driver recognize the duty cycle of phase-cut AC voltage delivered to it by a dimmer (which may be a traditional thyristor or triac dimmer or a modern control device emulating one), and to control the light intensity of the LEDs accordingly. However, such phase-cut dimming involves constantly applying the same rhythm of on- and off-periods in each half-wave of the AC operating power, while in the above-explained embodiment of the invention it is assumed that each active period and each interruption in operating power has the duration of several periods of the AC operating power; even hundreds or thousands of periods or more. Also, even if sending the same command a number of times may improve reliability and decrease the possibility of misinterpreting, the embodiment of the invention described above may work perfectly well with each message or command transmitted only once, e.g. requiring only one temporary interruption in operating power. Switching the AC operating power at the accuracy required for phase-cut dimming, and appropriately recognizing the duty cycle at the driver, requires sophisticated circuitry with a time resolution measured in microseconds, while for the purposes of the embodiment of the present invention a time resolution of tens of milliseconds, or even seconds, may be quite sufficient.

Concerning the direction in which energy flows through the apparatus 801, the energy storage 806 is schematically drawn after the monitoring portion 803. This way it is emphasized that the monitoring portion 803 should be aware of the length of active periods and interruptions in the operating power, while the remaining part of the apparatus 801 may remain unaware of any temporary interruptions in operating power. The arrow from the monitoring portion 803 to the mode setting portion 804 illustrates how the former is configured to inform the latter about a recognized mode setting command encoded as active periods and/or interruptions in the operating power. However, the schematic illustration does not limit the actual implementation of the monitoring portion 803. As an example, a monitoring portion may be configured to monitor the flow of current out of an energy storage; such flow occurs in significant amounts only when there is an interruption in the operating power.

An example of an application environment where an apparatus of the kind shown in FIG. 8 can be used is a building where a previously existed lighting system is replaced with controllable LED luminaires. In many cases the old lighting system did not include any control cables, because e.g. dimming was implemented with hand-operated thyristor or triac dimmers that only required cabling for operating power to the location of the luminaire. A modern, controllable LED luminaire comprises a driver, to which the commands concerning e.g. dimming or color control should be sent through a control line such as a DALI bus. Conveying the control commands in the form of active periods and/or interruptions instead, as described above, makes the installing of control cables unnecessary.

In addition, modern LED luminaires typically consume much less power than older devices that were based on e.g. incandescent bulbs or discharge lamps. The delivery of operating power to the luminaires may have been originally dimensioned for the needs of such older devices, so that its capacity is more than sufficient to deliver not only the energy that is directly needed to drive the LEDs in the new luminaires but also the energy that charges the energy storage in or at the disposal of the driver. Conversely, driving the LEDs may not require continuous supply of operating power at the full original capacity of the system, but the energy that the driver receives during only active periods may suffice, with the energy storage locally making up for the energy needs during temporary interruptions.

Figure 9:
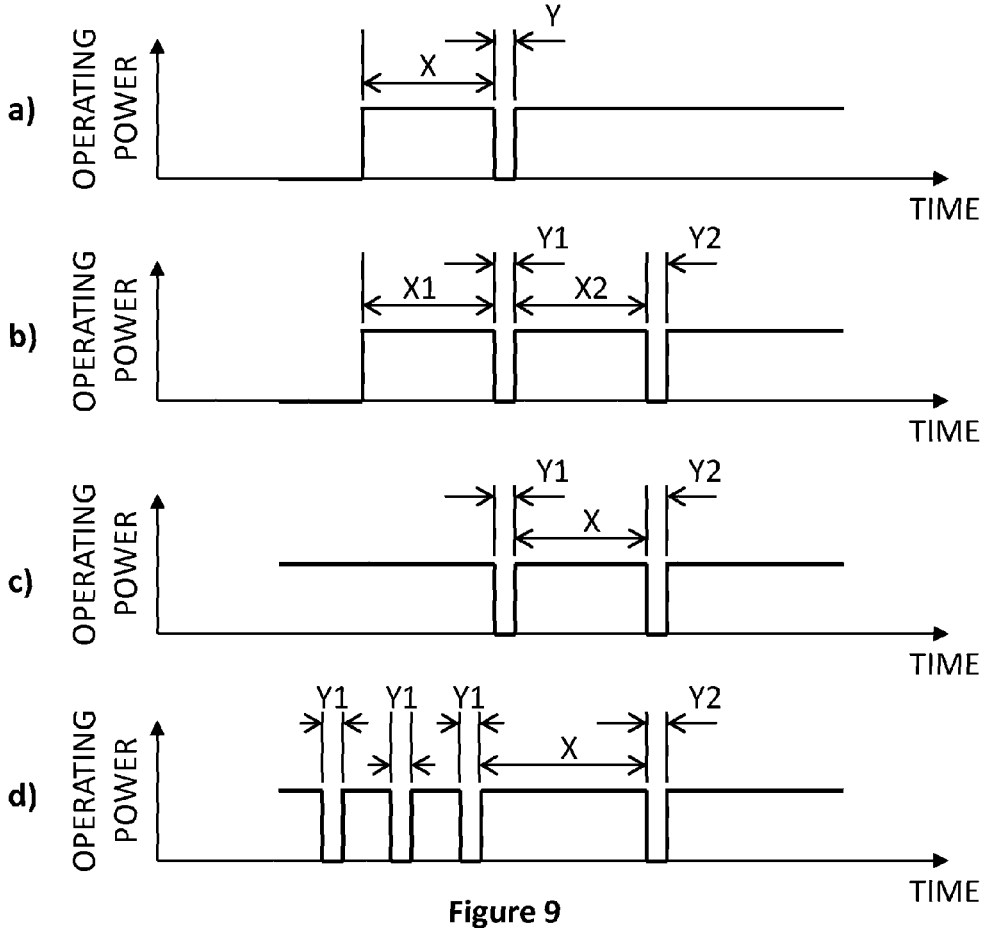
FIG. 9 illustrates examples of sequences of active periods and temporary interruptions.

FIG. 9*a* illustrates a sequence of active periods and interruptions according to a first illustrative example of the embodiment of the invention described above with reference to FIG. 8. In the example of FIG. 9*a* the operating power is first off. Then it is switched on for an active period of duration X, after which follows a temporary interruption of duration Y, followed by another active period which in this example may last for some longer period of time during which the light sources should emit light.

The way in which the apparatus 801 should react to a sequence like that in FIG. 9*a* can be selected among a number of possibilities, by programming the functions of the apparatus accordingly. A first alternative is the one described earlier in this description with reference to e.g. FIG. 4, in which switching the operating power on at the beginning of the first active period does not yet cause the light sources 802 to be switched on. In other words, the active period of length X would be considered a program setting period, the length of which makes the apparatus 801 select the lighting program that it will employ after the operating power is switched on for a longer time following the temporary interruption of length Y.

A second alternative is that the apparatus 801 switches the light sources 802 on already at the beginning of the first active period. The lighting intensity to which the light sources 802 are initially set may be e.g. full intensity, or the intensity that was employed last before switching the light sources off last time, or some predefined preparatory lighting intensity. The length X of the first active period then makes the apparatus 801 select the lighting program it will employ after the temporary interruption of length Y, without switching the light sources 802 off or otherwise changing the light intensity for the duration of said temporary interruption.

Yet another alternative is otherwise the same as the second alternative described above, but with the change that when the first active period of length X ends and the apparatus consequently knows the lighting program to be selected, it begins operating according to the selected lighting program already during the temporary interruption of length Y.

Yet another alternative is otherwise the same as the second alternative described above, but with the change that when the first active period of length X ends and the apparatus consequently knows the lighting program to be selected, it gives a visual indication as an acknowledgement that the newest command has been received and understood, for example by briefly blinking the light sources 802 to full intensity, before continuing operation according to the selected lighting program either during or after the temporary interruption of length Y.

FIG. 9*b* illustrates a sequence of active periods and interruptions according to a second illustrative example of the embodiment of the invention described above with reference to FIG. 8. In the example of FIG. 9*b* the operating power is first off. Then it is switched on for an active period of duration X1, after which follows a temporary interruption of duration Y1, followed by another active period of duration X2, and another temporary interruption of duration Y2. After that follows yet another active period, which in this example may last for some longer period of time during which the light sources should emit light.

The embodiment illustrated in FIG. 9*b* is somewhat more versatile than that of FIG. 9*a*, because while in FIG. 9*a* the information content of the command or message could only be encoded in the duration X of the active period and/or the duration Y of the subsequent temporary interruption, in FIG. 9*b* there are a total of four time intervals X1, Y1, X2, and Y2, each of which may convey some information encoded in its length in time.

FIG. 9*c* illustrates a sequence of active periods and interruptions according to a third illustrative example of the embodiment of the invention described above with reference to FIG. 8. In the example of FIG. 9*c* the operating power is first on, which means that the apparatus is employing some lighting program that has been selected earlier. Then a temporary interruption of length Y1 occurs in the operating power, followed by an active period of duration X, after which follows another temporary interruption of length Y2.

The temporary interruptions of lengths Y1 and Y2 may be employed simply to make an active period of length X appear between two longer active periods of indefinite length. In such a case we assume that it is the length X of the active period that carries the information content of the command or message to be conveyed to the apparatus 801, so that the lengths Y1 and Y2 are of no importance; they may be e.g. equal (Y1=Y2), or the temporary interruptions may have some other lengths of which it suffices to know that they are shorter than (or equal to) the maximum temporary interruption the effect of which the apparatus 801 can mask using energy taken from the energy storage 806.

Another possibility is that all lengths X, Y1, and Y2 carry some information in the case of FIG. 9*c*. As in FIG. 9*b*, there may be two or more active periods, separated from each other by temporary interruptions. FIG. 9*c* illustrates how the principle of temporary interruptions in operating power that are sufficiently short to be made up for by the energy storage 806 can be utilized to convey messages or commands to the apparatus 801 even when it is already employing some previously selected lighting program.

FIG. 9*d* illustrates in general the principle or using repetition to ensure that commands or messages are interpreted correctly in the apparatus 801. In FIG. 9*d* we again assume that the operating power is already on, but a further command or message should be conveyed to the apparatus 801. As a wake-up sign for the monitoring portion 803, three consecutive temporary interruptions are made in the operating power, each having the length Y1. After the third of these, there follows an active period of length X, followed by yet another temporary interruption of length Y2. The information content of the message or command to be conveyed in FIG. 9*d* is encoded in the length X of the active period and/or the length Y2 of the last temporary interruption. The monitoring portion 803 in the apparatus 801 has been programmed to only begin observing the duration of an active period—in the sense of conveying the observed duration to the mode setting portion 804 as a command to obey certain lighting program—if three temporary interruptions of predetermined length are first observed within a predetermined time window.

The principle of repetition, which in FIG. 9*d* is illustrated as the repetition of temporary interruptions of length Y1 as a wake-up sign, can be generalized to the repetition of active periods. For example, in FIG. 9*b* the lengths X1 and X2 of the active periods could be the same, with the meaning that the apparatus 801 should only take them as a command if X1=X2 at some predetermined accuracy.

Repetition of active periods and/or temporary interruptions may also as such constitute a vehicle of conveying information. For example if the monitoring portion 803 is only capable of detecting the occurrence of a separate active period and/or the occurrence of a temporary interruption, regardless of its exact length in time, the apparatus 801 may have been programmed to interpret one distinct active period (or one temporary interruption) as a command for employing a first lighting program, two distinct active periods (or two temporary interruptions) as a command for employing a second lighting program etc.

Figure 10:
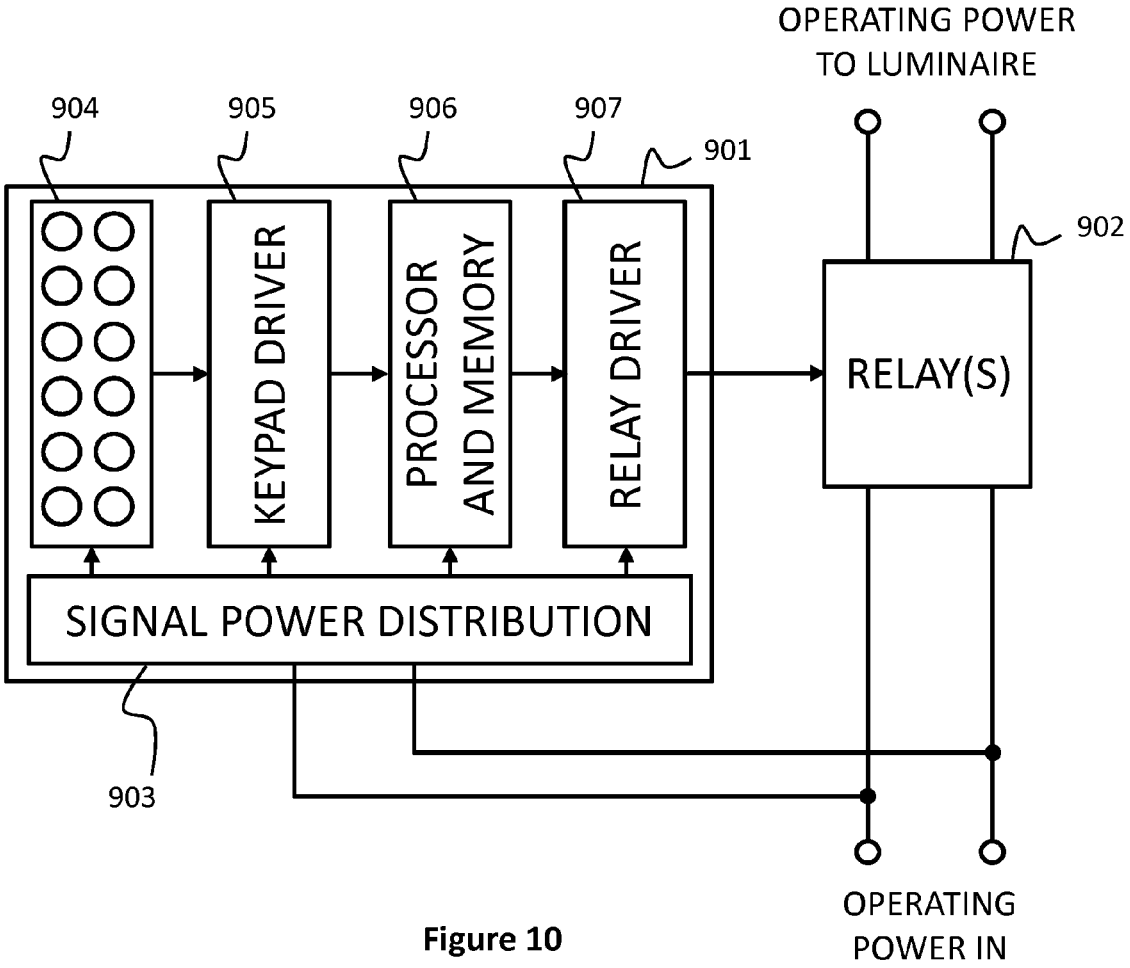
FIG. 10 schematically illustrates a control entity in accordance with an example embodiment.

FIG. 10 illustrates schematically a control entity that can be used in association with any embodiments of the invention described in the preceding text. As a particular example, using the control entity of FIG. 10 in association with an apparatus 801 of FIG. 8 is described.

The control entity comprises an electronics portion 901 and a switch portion 902, of which the latter can also be designated a relay portion, because its operation is easy to understand as including one or more relays. This designation is not restrictive; for example, the switching functions of the switch portion 902 can be realized with solid-state switches equally as with electromechanical relays. Also the illustration of the electronics portion 901 and the switch portion 902 as separate entities does not mean that they should be physically different entities, but both can be realized within a single entity. It is customary to use a so-called backbox to house the functional parts of e.g. a wall switch that a human user normally uses to operate the lighting of a room, and in terms of psychological and electromechanical compatibility it may be advantageous to build both the electronics portion 901 and the switch portion 902 so that they both fit in a common backbox.

Operating power is for example 230 volts 50 Hz AC mains. A signal power distribution block 903 is configured to produce and distribute the voltages that are needed in the functional parts of the electronics portion 901. A user interface 904 is provided; it may comprise e.g. a keypad, a touchpad, one or more switches, one or more slides, or some other means through which a human user may issue commands indicating what lighting programs the associated luminaire(s) should employ. In FIG. 10 the user interface is schematically illustrated as a keypad. A driver, here schematically illustrated as a keypad driver 905, may be employed to convert the operations of the user into processor-readable form. A processor and memory portion 906 is configured to interpret the commands given by the user, and to instruct another driver, which here is schematically illustrated as the relay driver 907. The switch(es) in the switching portion 902 are configured to switch the operating power to the associated luminare(s) on and off as instructed by the relay driver 907.

As an example, we may assume that one of the lighting programs of an associated luminaire corresponds to setting the light sources to 60% lighting intensity. A button in the user interface 904 is marked with a text "60%" or with a graphical symbol that a user can easily interpret as meaning 60% lighting intensity. When the user presses that button, the processor and memory portion 906 receives—through the keypad driver 905—an indication that 60% lighting intensity is desired. A preprogrammed communications protocol is known to both the processor and memory portion 906 and the apparatus 801 shown in FIG. 8. According to said communications protocol, an active period of 1.4 seconds repeated twice in immediate succession corresponds to a command of setting lighting intensity to 60%. If the operating power to the luminaire was already on, the processor and memory portion 906 makes, through the relay driver 907, the switch portion 902 temporarily interrupt the operating power to the luminaire three times, so that these three temporary interruptions define two distinctive active periods, each having a duration 1.4 seconds. Alternatively, if the operating power to the luminaire was not on to begin with, the processor and memory portion 906 makes, through the relay driver 907, the switch portion 902 switch the operating power on and then temporarily interrupt the operating power to the luminaire two times, so that together with initially switching the operating power on the two temporary interruptions define two distinctive active periods, each having a duration 1.4 seconds.

The example above is easily generalized to cover all kinds of commands that the control entity of FIG. 10 can transmit to the apparatus of FIG. 8.

In the entire description provided hereinbefore, a reference to a processor should not be understood to encompass only programmable processors, but also dedicated circuits such as field-programmable gate arrays (FPGA), application specific circuits (ASIC), signal processors, etc. Features described in the preceding description may be used in combinations other than the combinations explicitly described. Although functions have been described with reference to certain features, those functions may be performable by other features whether described or not. Although features have been described with reference to certain embodiments, those features may also be present in other embodiments whether described or not.

The invention claimed is:

1. An apparatus for driving one or more light sources, the apparatus comprising:

one or more processors and one or more memories storing computer executable instructions that when executed by the one or more processors cause the apparatus to at least:

observe durations of active periods, wherein an active period corresponds to a continuous period of operating power being supplied to the apparatus, select one of a plurality of lighting programs for the apparatus in accordance with the observed durations of one or more active periods, wherein a lighting program defines the desired characteristics of light provided by the one or more light sources as a function of time for a subsequent active period, and in response to an active period, control provision of operating power from the apparatus to the one or more light sources in accordance with the most recently selected lighting program.

2. An apparatus according to claim 1, wherein the selected lighting program defines the desired light intensity provided by the one or more light sources as a function of time.

3. An apparatus according to claim 1, wherein the selected lighting program comprises a plurality of temporally adjacent segments, each segment having predetermined characteristics of light and duration defined therefor.

4. An apparatus according to claim 3, wherein the computer executable instructions, when executed, cause the apparatus to determine at least one of: a starting time of a currently applied lighting program and an ending time of at least one segment of a currently applied lighting program in accordance with a predetermined rule on basis of the observed duration of one or more completed active periods.

5. An apparatus according to claim 4, wherein said one or more completed active periods are completed active periods having duration that exceeds a first predetermined threshold duration.

6. An apparatus according to claim 1, wherein the computer executable instructions, when executed, cause the apparatus to select, in response to a first active period having duration falling below a second predetermined threshold duration, the operating mode in accordance with the duration of said first active period.

7. An apparatus according to claim 6, wherein the second threshold duration comprises two or more non-overlapping sub-ranges, and wherein the computer executable instructions, when executed, cause the apparatus to determine a sub-range within which the duration of the first active period falls, and select the lighting program associated with said determined sub-range.

8. An apparatus according to claim 7, wherein the computer executable instructions, when executed, further cause the apparatus to modify, in response to determining the duration of the first active period to fall within a predetermined sub-range, at least one characteristic of one or more of said plurality of lighting programs in accordance with durations of one or more second active periods following the first active period.

9. An apparatus according to claim 6, wherein the computer executable instructions, when executed, further cause the apparatus to provide operating power from the apparatus to the one or more light sources in accordance with the most recently selected lighting program in response to a third active period having duration exceeding a third predetermined threshold duration, which third threshold duration is longer than or equal to said second predetermined threshold duration.

10. An apparatus according to claim 1, wherein the computer executable instructions, when executed, further cause the apparatus to compute a value of a remainder of the duration of a completed active period divided by a predetermined divisor, and select the lighting program in accordance with the value of the remainder.

11. An apparatus according to claim 10, wherein a range of possible values of the remainder is divided into two or more non-overlapping sub-ranges, each sub-range associated with a respective lighting program, and wherein the computer executable instructions, when executed, further cause the apparatus to select the lighting program associated with the sub-range within which the value of the remainder falls.

12. An apparatus according to claim 1, wherein:

the apparatus comprises an energy storage, and the apparatus is configured to drive said one or more light sources with energy taken from said energy storage during an interruption between two consecutive active periods.

13. A lighting system, comprising:

one or more apparatuses, and a control entity configured to controllably divide operating power delivered to said apparatuses into active periods separated by temporary interruptions;

wherein at least one of said apparatuses comprises one or more processors and one or more memories storing computer executable instructions that when executed by the one or more processors cause the apparatus to at least:

observe durations of active periods, wherein an active period corresponds to a continuous period of operating power being supplied to the apparatus, select one of a plurality of lighting programs for the apparatus in accordance with the observed durations of one or more active periods, wherein a lighting program defines the desired characteristics of light provided by the one or more light sources as a function of time for a subsequent active period, and in response to an active period, control provision of operating power from the apparatus to the one or more light sources in accordance with the most recently selected lighting program.

14. A method for driving one or more light sources, the method comprising observing durations of active periods, wherein an active period corresponds to a continuous period of operating power being supplied to a driver apparatus, selecting one of a plurality of lighting programs for the driver apparatus in accordance with the observed durations of one or more active periods, wherein a lighting program defines the desired characteristics of light provided by the one or more light sources as a function of time for a subsequent active period, and controlling, in response to an active period, provision of operating power from the driver apparatus to the one or more light sources in accordance with the most recently selected lighting program.

15. A non-transitory memory storing a computer program for driving one or more light sources, the computer program including one or more sequences of one or more instructions which, when executed by one or more processors, cause a driver apparatus to at least perform the following:

observe durations of active periods, wherein an active period corresponds to a continuous period of operating power being supplied to the driver apparatus, select one of a plurality of lighting programs for the driver apparatus in accordance with the observed durations of one or more active periods, wherein a lighting program defines the desired characteristics of light provided by the one or more light sources as a function of time for a subsequent active period, and control, in response to an active period, provision of operating power from the driver apparatus to the one or more light sources in accordance with the most recently selected lighting program.

* * * * *